US006619781B2

(12) United States Patent
Kan

(10) Patent No.: US 6,619,781 B2
(45) Date of Patent: Sep. 16, 2003

(54) LIQUID EJECT APPARATUS AND EJECT RECOVERY METHOD

(75) Inventor: Shoichi Kan, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/977,316

(22) Filed: Oct. 16, 2001

(65) Prior Publication Data

US 2002/0054184 A1 May 9, 2002

(30) Foreign Application Priority Data

Oct. 19, 2000 (JP) ..... 2000-319757

(51) Int. Cl.[7] ..... B41J 2/165
(52) U.S. Cl. ..... 347/30; 347/29
(58) Field of Search ..... 347/30, 29, 23, 347/35

(56) References Cited

U.S. PATENT DOCUMENTS

| | | | | |
|---|---|---|---|---|
| 4,692,777 A | | 9/1987 | Hasumi | 346/140 R |
| 5,483,266 A | * | 1/1996 | Nakamura | 347/23 |
| 5,831,646 A | | 11/1998 | Kuronuma et al. | 347/30 |
| 6,079,809 A | | 6/2000 | Yaegashi et al. | 347/35 |
| 6,325,492 B1 | | 12/2001 | Koitabashi et al. | 347/57 |

FOREIGN PATENT DOCUMENTS

| | | |
|---|---|---|
| EP | 0 845 360 | 6/1998 |
| EP | 0 850 773 | 7/1998 |
| JP | 6-126947 | 5/1994 |
| JP | 2698419 | 9/1997 |
| JP | 9-267481 | 10/1997 |
| JP | 9-290517 | 11/1997 |
| JP | 10-67121 | 3/1998 |
| JP | 10-067121 | 3/1998 |

OTHER PUBLICATIONS

U.S. application No. 09/790,630, filed Feb. 23, 2001.

European Search Report, dated Nov. 25, 2002, in EP 01 12 4866, De Groot, R.

* cited by examiner

*Primary Examiner*—Shih-Wen Hsieh
(74) *Attorney, Agent, or Firm*—Fitzpatrick, Cella, Harper & Scinto

(57) ABSTRACT

An image forming apparatus and an image forming method constituted as follows can suppress a mix color phenomenon and the like without consuming a large amount of pre-ejected ink. A cap for attaching to/detaching from a liquid eject portion of the recording head is arranged. The recording head ejects liquid while the cap is moving from an attached state to the liquid eject portion to a detached state. Alternatively, a recording head for recording, the cap for capping a liquid eject portion of the recording head and a pump for sucking via the cap may be arranged. The recording head ejects liquid while the cap is moving from an attached state to the liquid eject portion to a detached state, after a sucking operation by the pump is executed.

19 Claims, 8 Drawing Sheets

LIQUID EJECT APPARATUS AND EJECT RECOVERY METHOD

BACKGROUND OF THE INVENTION

1. Field of the Invention

The present invention relates to a liquid eject apparatus equipped with a liquid eject head for ejecting liquid and relates to an eject recovery method of the liquid eject head.

2. Brief Description of the Related Art

An ink-jet printer, a typical example of liquid eject apparatuses, widely known as an image forming apparatus, is generally equipped with an eject recovery device for removing thickened ink, foreign particles and the like stuck to a liquid eject portion of its recording head so as to keep a stable ejecting performance of the ink-jet printer. As shown in FIG. 8 for example, the eject recovery device comprises one or a plurality of caps 2 for covering a liquid eject portion 5*a* of a recording head 5 during non-printing operations to prevent ink as a liquid for recording from drying or evaporating and a pump 4 for sucking the thickened ink from and around the liquid eject portion 5*a* via the cap 2.

The above-mentioned eject recovery device is for example, arranged at a pre-determined standby position apart from a recording movement area of the recording head 5 of the ink-jet printer so as to face the recording head 5. The recording head 5, for example, is arranged below an ink cartridge 1 detachably mounted on a carriage (not shown in FIG. 8).

The pump 4, for example as also shown in the Japanese laid open patent No. 10-67121, comprises a cylinder connected to the inside of the cap 2 via a connecting tube 11 and a piston (not shown in FIG. 8) which reciprocally moves along an inner circular surface of the cylinder in a direction depicted by a bilateral horizontal arrow in FIG. 8 so as to generate a pre-determined negative pressure in the cap 2. Ink is sucked from and around the liquid eject portion 5*a* of the recording head 5, when the pump 4 is operated as the cap 2 is kept contacting closely to the liquid eject portion 5*a* of the recording head 5.

The cap 2 is held by a cap holder 3 rotatably supported by a cam surface formed on a cap cam 9 so as to move in directions depicted by a arched bi-directional arrows in FIG. 8, so that cap 2 selectively can be attached closely to the liquid eject portion 5*a* of the recording head 5 as depicted in two-dot chain lines in the figure, or can be detached from the liquid eject portion 5*a* of the recording head 5 as depicted respectively in solid lines in the figure.

The rotating movement of the cap holder 3 is controlled in accordance with a shape of the cam surface formed on the cap cam 9 which transmits a driving force from a driving power source to a supporting mechanism of the cap holder 3 at predetermined timings. The reciprocating movement of a piston rod 6 is controlled in accordance with a shape of the cam surface formed on a pump cam 7 which transmits the driving force from the driving power source to the piston rod 6 at predetermined timings.

The eject recovery treatment is executed according to the following operating procedures. The cap cam 9 is driven so that the cap 2 held in the cap holder 3 is moved from a pre-determined position and attached closely to the recording head 5. From a pre-determined initial position, the piston (not shown in FIG. 8) is moved reciprocally in accordance with synchronous movements of the piston rod 6 driven by the synchronously moving pump cam 7 so that a predetermined amount of ink is sucked from the recording head. Then the cap 2 is detached from the liquid eject portion 5*a* of the recording head 5 and returned to the initial position. Simultaneously the piston is moved to a predetermined position and is moved reciprocally for discharging ink filled in the inside of the cap 2 and the pump 4. Finally the piston is returned to the initial position. Thus a series of operations are executed continuously.

When a plurality of color ink tanks are mounted on the recording head 5 equipped with a color cartridge where a plurality of nozzle rows for respective colors or a plurality nozzle groups for respective colors arranged on one nozzle row, usually caps for respective colors are not arranged, but one or smaller number of caps than color number to cover a plurality nozzle rows or nozzle groups are arranged so as to simplify a sucking mechanism and reduce a production cost of the liquid eject apparatus.

However, in the above-mentioned conventional examples, a plurality of inks mix each other and form a turbid ink which fill the inside of the cap, when the sucking operation is executed. Even after the cap is detached from the liquid eject portion of the recording head, the remaining turbid ink stuck to the liquid eject portion is mixed with ink inside nozzles. Which causes a problem the so called "mixed color phenomenon" such that light colors such as yellow and the like are contaminated by the remaining turbid ink, when information is recorded on a recording medium.

As a measure trying to prevent the mixed color phenomenon, the turbid ink is ejected from the nozzles by executing pre-ejection, after a series of operations and a succeeding detaching operation of the cap from the recording head are finished, but before a recording operation is started.

However owing to ink properties and other various conditions a problem that the pre-determined amount of pre-ejection is not enough to eject mixed ink completely, is remained unsolved, consequently a fairly amount of ink has to be wasted for the pre-ejection in the following cases: (1) A large amount of ink remains in the recording head after detaching the cap from the recording head; (2) A large negative pressure (holding pressure) inside of the ink tank mounted on the recording head causes the more aggravated "mixed color phenomenon" due to a large amount of mixed ink flowing into nozzles.

SUMMARY OF THE INVENTION

The present invention is carried out in view of the problems mentioned above so as to provide an image forming apparatus and an image forming method which can solve problems such that a large amount of pre-ejected ink is consumed for preventing the mix color phenomenon and the like.

The following constitutions according to the present invention can solve the above-mentioned problems.

(1) A liquid eject apparatus comprising: a cap for capping a liquid eject portion for ejecting liquid, where: liquid is ejected from the liquid eject portion while the cap and the liquid eject portion are relatively moving from a closely attached state to a detached state.

(2) A liquid eject apparatus comprising: a liquid eject portion for ejecting liquid; a cap for capping the liquid eject portion; and a sucking means for sucking liquid from the liquid eject portion via the cap, where: after sucking by the sucking means is finished, liquid is ejected from the liquid eject portion while the cap and the liquid eject portion are relatively moving from a closely attached state to a detached state.

(3) The liquid eject apparatus according to (2), where: after sucking by the sucking means is executed, ejecting liquid from the liquid eject portion is started while the relative movement is started when a pressure inside the cap returns to almost atmospheric pressure.

(4) The liquid eject apparatus according to (2), where: after sucking by the sucking means is executed, ejecting liquid from the liquid eject portion is started before a pressure inside the cap returns to almost atmospheric pressure; and then the relative movement is started.

(5) The liquid eject apparatus according to (2) or (3), where: sucking by said sucking means is executed again as said cap and the liquid eject portion are mutually being detached.

(6) The liquid eject apparatus according to (5), where: a gap formed between the cap and the liquid eject portion during the detached state is set between 0.1 mm and 1.5 mm.

(7) The liquid eject apparatus according to (5), where: sucking by the sucking means is executed again before ejecting liquid from the liquid eject portion is finished.

(8) The liquid eject apparatus according to (1) or (2), where: ejecting liquid from the liquid eject portion during the relative movement is executed against the cap.

(9) The liquid eject apparatus according to (1) or (2), where: the cap is capping a plurality of the liquid eject portion, which respectively eject different liquids, altogether.

(10) The liquid eject apparatus according to (1) or (2), where: the liquid eject portion is equipped with electrothermal conversion modules to generate thermal energy utilized for ejecting liquid.

(11) An eject recovery method comprising steps of: relatively moving a liquid eject portion for ejecting liquid and a cap for capping the liquid eject portion from a closely attached state to a detached sate; and ejecting liquid from the liquid eject portion; where: both moving and ejecting steps are executed concurrently.

(12) An eject recovery method comprising steps of: sucking liquid from a liquid eject portion for ejecting liquid while a cap for capping the liquid eject portion caps the liquid eject portion; relatively moving the liquid eject portion and the cap from a attached state to a detached sate; and ejecting liquid from the liquid eject portion; where: both moving and ejecting steps are executed concurrently.

(13) The eject recovery method according to (11), where: after sucking liquid from the liquid eject portion, ejecting liquid from the liquid eject portion is started when a pressure inside the cap returns to almost atmospheric pressure.

(14) The eject recovery method according to (11), where: after sucking by the sucking means, ejecting liquid from the liquid eject portion is started before a pressure inside the cap return to almost atmospheric pressure; and then the relative movement is started.

(15) The eject recovery method according to (11) or (12), where: sucking by the sucking means is executed again as the cap and the liquid eject portion are mutually being detached.

(16) The eject recovery method according to (15), where: a gap formed between the cap and the liquid eject portion during the detached state is set between 0.1 mm and 1.5 mm.

(17) The eject recovery method according to (15), where: sucking by the sucking means is started again before ejecting liquid from the liquid eject portion is finished.

(18) The eject recovery method according to (11) or (12), where: ejecting liquid from the liquid eject portion during the relative movement is executed against the cap.

(19) The eject recovery method according to (11) or (12), where: the cap is capping a plurality of the liquid eject portion, which respectively ejecting different liquids, altogether.

DETAILED DESCRIPTION OF THE PREFERRED EMBODIMENTS

Hereinafter embodiments according to the present invention are explained by referring to drawings.

Figure 1:
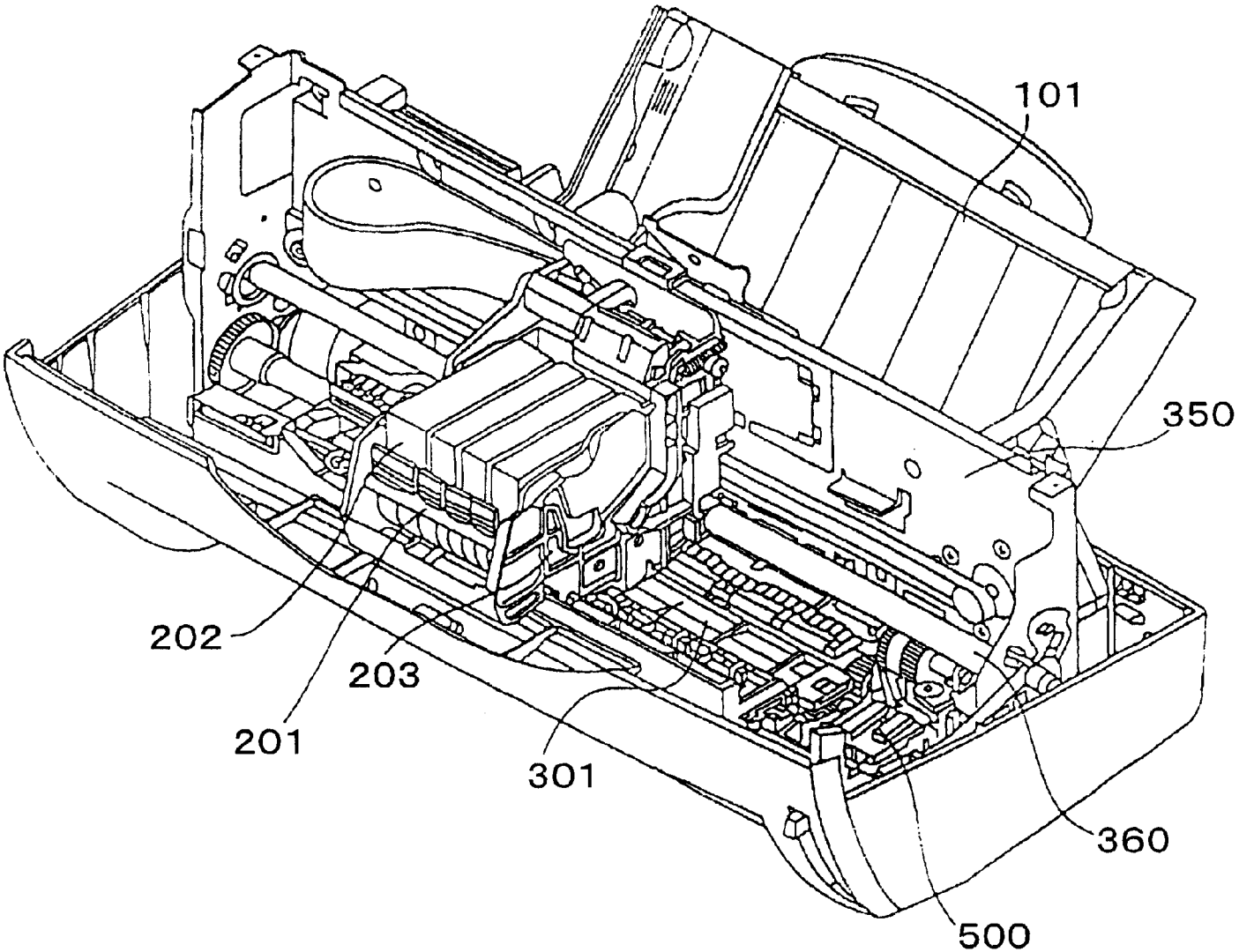
FIG. 1 is a perspective view showing an ink-jet printer as an example of image forming apparatuses according to the present invention.

FIG. 1 is the perspective view showing the ink-jet printer with the upper cover removed, as an example of image forming apparatuses according to the present invention.

A sheet (a medium to be recorded) mounted on a paper supply tray 101 is supplied by revolving paper supply rollers (not shown in FIG. 1) and fed onto a platen 301 by feeding rollers (not shown in FIG. 1). While the sheet is being fed, a recording (forming) an image and the like is executed by ejecting ink from the recording head mounted on a carriage 203 onto the sheet in accordance with scanning movements of the recording head.

The above-mentioned recording head 201 and an ink tank 202 where ink is stored for supplying ink to the recording head are detachably mounted on the carriage 203. The carriage 203 is slidably connected to a scanning rail 360 supported by a chassis 350 so as to scan the above-mentioned recording head by transmitting a driving force from a carriage motor (not shown in FIG. 1) via a transmitting mechanism such as a belt. At the one end of scanning region of the carriage 203, a recovery unit 500 for executing eject recovery treatments so as to maintain a ejecting performance of the recording head 201 in a good state.

Some functions of the recovery unit 500, which is explained later by referring to FIG. 3, shares a driving power source with the supply rollers so that a switching mechanism to switch the driving power is equipped in the recovery unit. In the same way, other function of the recovery unit 500 shares other driving power source with feeding rollers so that other switching mechanism to switch the other driving power is equipped in the recovery unit.

As mentioned above the recording head 201 and the ink tank 202 are detachably mounted on the carriage 203. In the present embodiment, however, a tank holder equipped with the ink tank is mounted on a holder monolithically formed with the recording head 201, which is integrally mounted on the carriage 203. The above-mentioned recording head 201 and ink tank 202 are constituted so as to meet requirements of respective inks i.e. black, cyan, magenta and yellow inks for recording. Further the recording head 201 of the present embodiment employs the so-called bubble jet method, where a pressure caused by bubbles generated in ink by utilizing thermal energy so as to eject ink. In order to supply thermal energy for generating bubbles to eject ink, the above-mentioned recording head 201 is equipped with electro-thermal energy conversion modules (not shown in FIG. 1).

Figure 2:
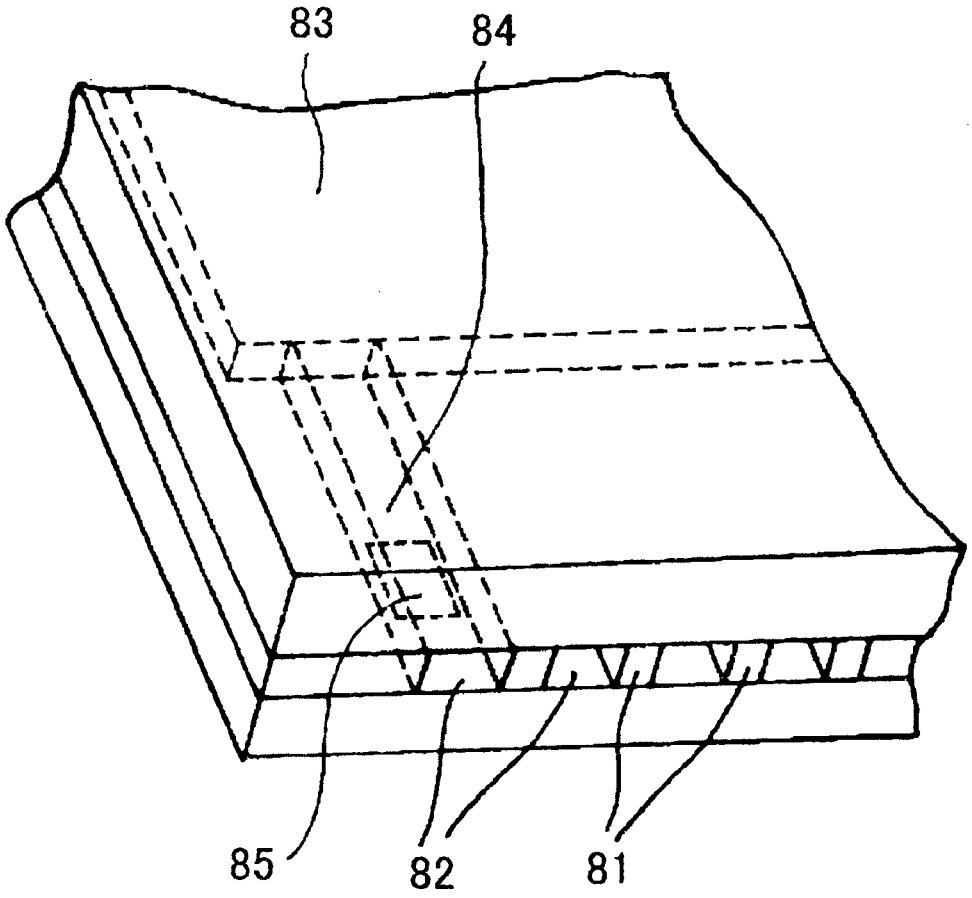
FIG. 2 is a partial perspective view schematically depicting a structure of eject portion of the recording head.

FIG. 2 is the partial perspective view schematically depicting a structure of eject portion of the recording head. A plurality of eject ports 82 are formed by a predetermined pitch on eject port surface 81 facing against the medium to be recorded by a predetermined gap (for example, ca. 0.2 to ca. 0.3 mm). Electro-thermal energy conversion modules (exothermic resistance modules, heaters) 85 for generating energy to eject ink are arranged along walls of respective liquid paths 84 communicating a common liquid chamber 83 and respective eject ports 82 together. The recording head 201 is mounted on the carriage 203 in a way where a row of eject ports is positioned so as to cross a main scanning direction (a moving direction of the recording head and carriage). When electro-thermal energy conversion modules are driven (applied electricity), inks in liquid paths 84 are brought to a film boiling and are ejected from eject ports 82 by generated pressure from the film boiling.

Figure 3:
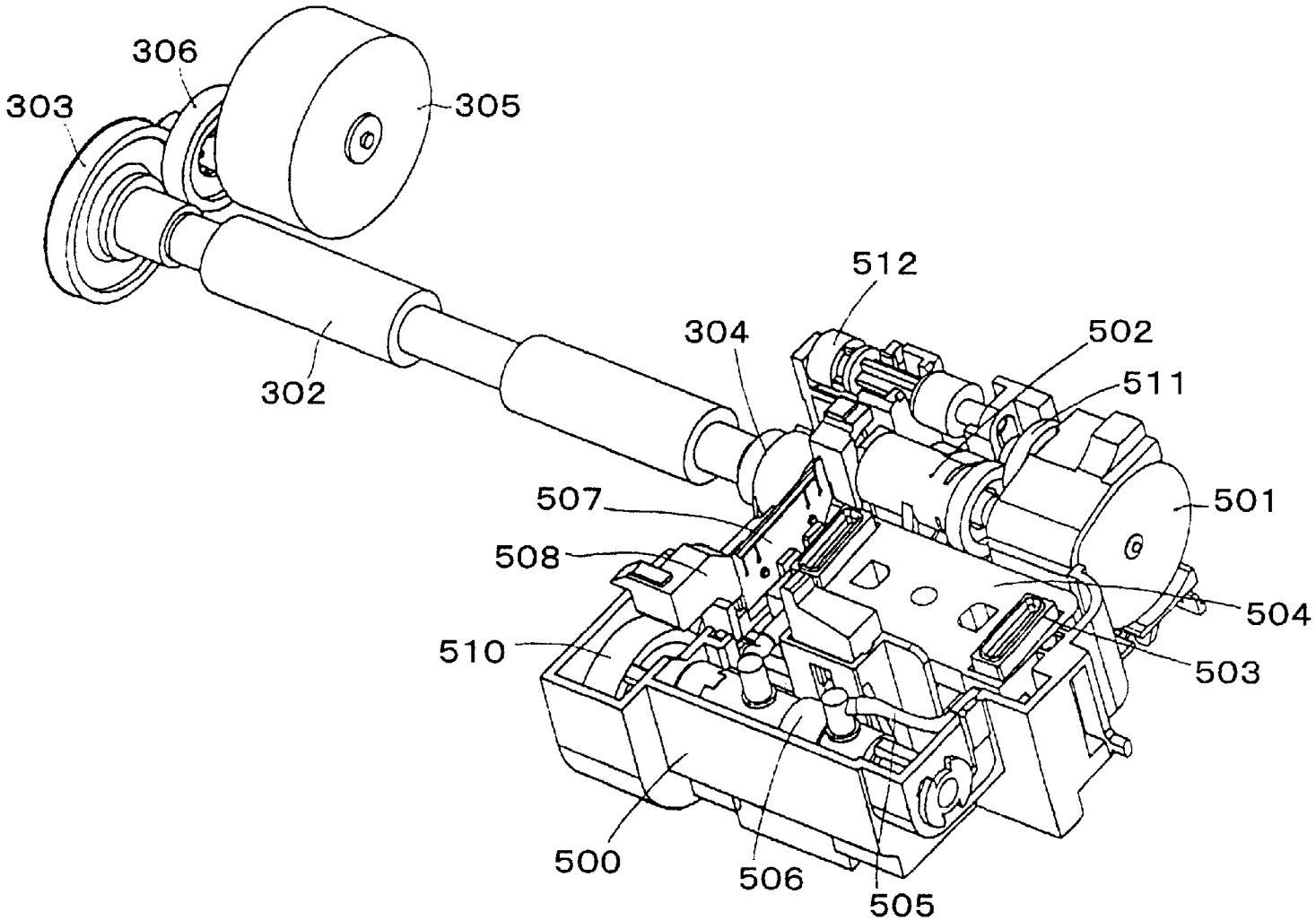
FIG. 3 is a perspective view showing an eject recovery unit of the ink-jet printer and a driving power source from which a driving power is transmitted to the eject recovery unit.

FIG. 3 is the perspective view showing the recovery unit 500 of the ink-jet printer shown in FIG. 1 and the driving power source transmitting the driving power to the recovery unit 500.

Reference numeral "305" is an LF motor as a first driving power source and reference numeral "501" is an AP motor as a second driving power source.

The driving force generated in the LF motor 305 functioning as the first driving power, is transmitted to a pump driving gears (not shown in FIG. 3) arranged in the recovery unit 500 via an LF reduction gear 306, an LF gear 303, a feeding roller 302 and an LF transmission switching mechanism 304. And finally a driving cam 510 is driven by the above-explained transmitted driving power.

A paper supplying mechanism (not shown in FIG. 3) is driven by the transmitted driving power, when the driving power generated in the AP motor functioning as the second driving power source, is transmitted to a paper supplying output gear 512 via an AP reduction gear 511 and an AP transmission switching mechanism 502. A cap holder 504 and a wiping means 508 are driven by the transmitted power, when the driving power is transmitted to a cap cam (not shown in FIG. 3) via the AP transmission switching mechanism 502. In the above-mentioned arrangement, the AP transmission switching mechanism 502 can transmit the driving force to either one of ways mentioned above in accordance with revolving directions of the AP motor 501.

The recovery unit 500 has a cap 503 for covering the liquid eject portion of the recording head during non-printing operations to prevent ink from drying and evaporating, and also has the cap holder 504 which supports the cap 503. The cap arrangement mentioned above can execute capping movements, namely the cap 503 can be attached closely to or detached from the liquid eject portion of the recording head 201 by the AP motor functioning as the second driving power source.

The cap 503 is communicated to a pump 506 via the cap holder 504 and a joint tube 505. In this way the sucking operation can be executed by the driving force from the LF motor 305 functioning as the above-mentioned first driving power source.

A blade 507 and a blade holder 508 which holds the blade 507, can execute wiping operations to remove stuck ink and the like to the recording head 201 through the driving force from the AP motor 501 functioning as the second driving power.

Hereinafter respective operations of a series of recovering operations in the arrangement mentioned above are explained.

Figure 4:
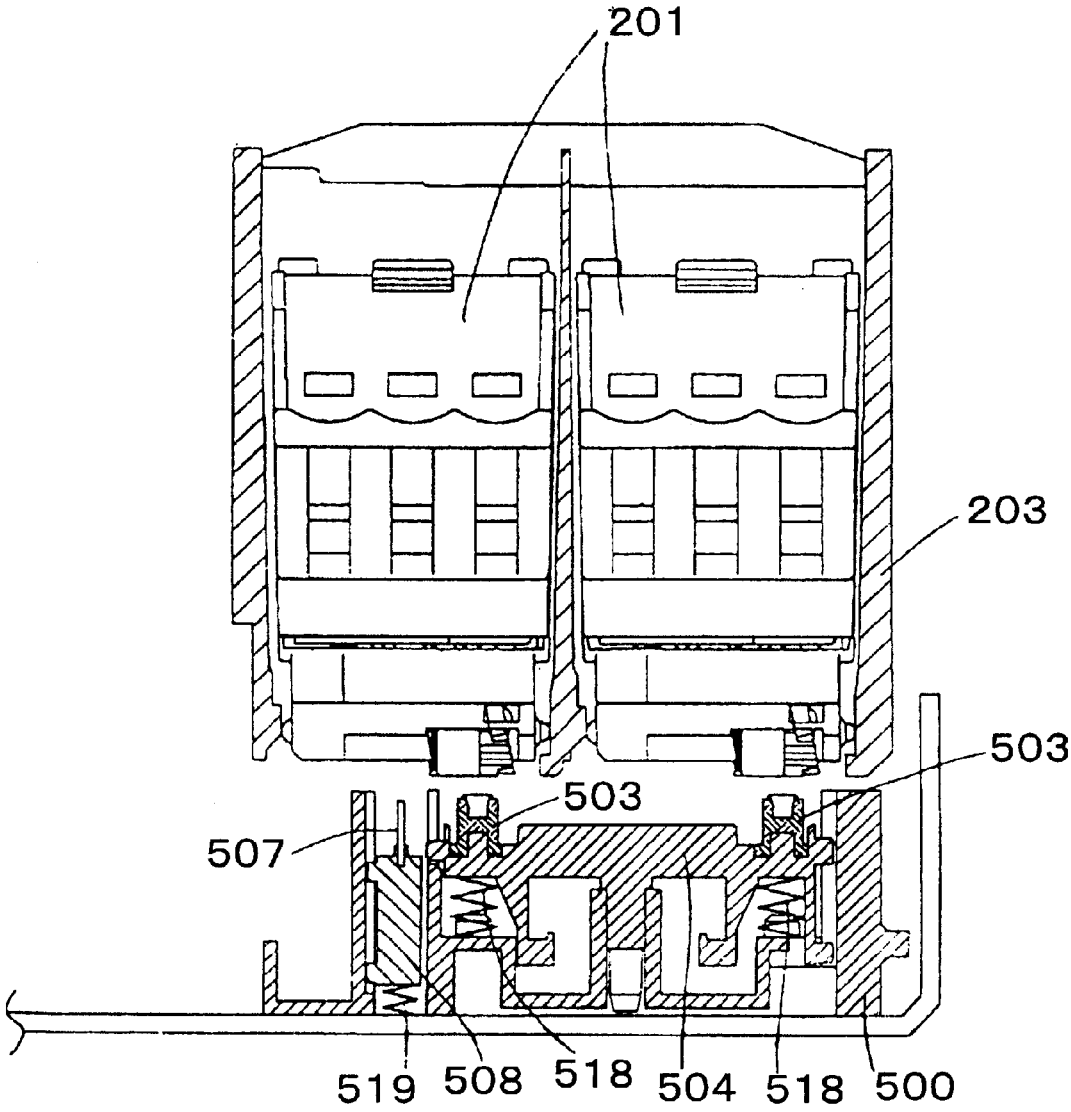
FIG. 4 is a sectional view for explaining a series of movements of a recording head during the eject recovery operation (where a cap, a blade and the recording head are in detached states).
Figure 5:
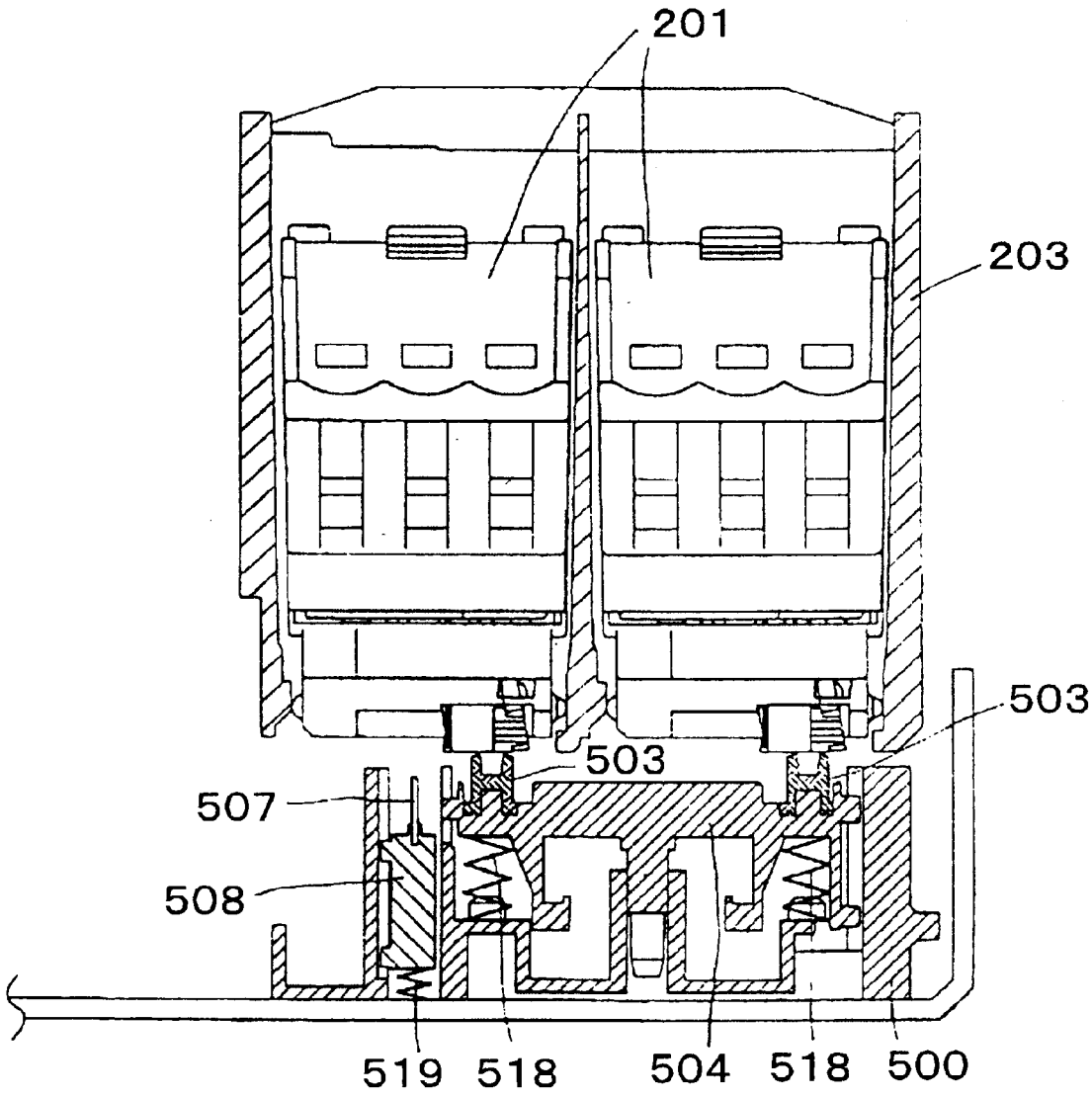
FIG. 5 is a sectional view for explaining a series of movements of the recording head during the eject recovery operation (where the cap is attached to the recording head).
Figure 6:
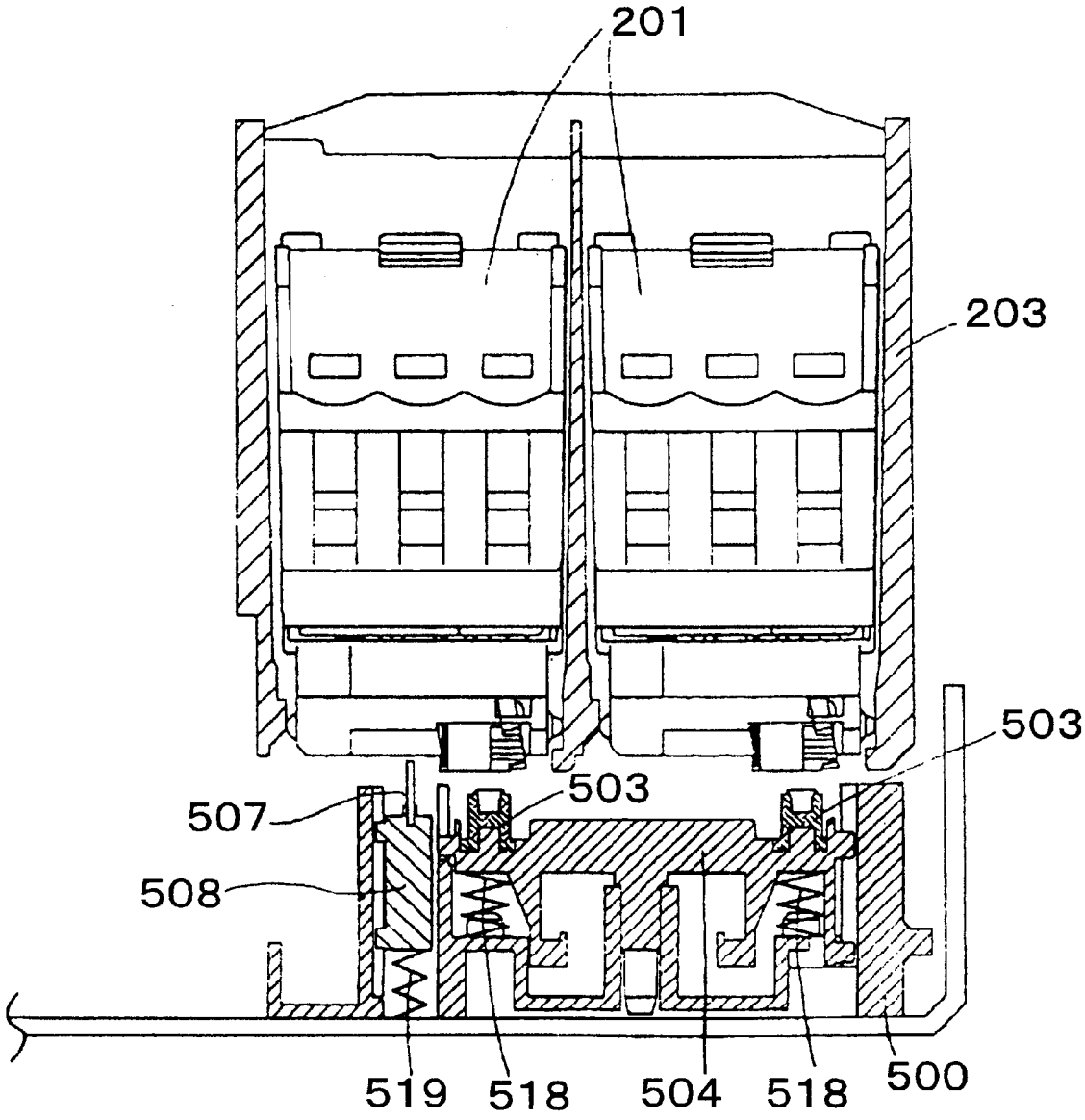
FIG. 6 is a sectional view for explaining a series of movements of the recording head during the eject recovery operation (ready for a wiping operation).

FIGS. 4 to 6 are sectional views illustrating a series of recovering operations of the recording head.

In FIG. 4 both the cap 503 and the blade 507 are detached from the recording head 201, namely, they are positioned in an inactive status against movements of the carriage 203. The recovery unit 500 is placed in the position shown in FIG. 4 in ordinary printing operations. Consequently, since a starting point of the main scanning operation of the carriage 203 is kept at a position where the recording head 201 and the cap 503 are facing each other as shown in FIG. 4, other carriage positions beyond the starting position for switching operation and the like, are not required.

FIG. 5 shows the so-called capping status, namely a contacting status of the cap 503 to the recording head 201 mounted on the carriage 203, which is moved to a facing position against the cap 503.

When a cap cam (not shown in FIG. 5) revolves, the cap 503 is contacted to the facing recording head 201 by an applied pressure on the cap holder 504 generated by a cap spring 518. As mentioned above, ink and the like can be sucked from the recording head 201 by driving the pump (see FIG. 3). In ordinary standby statuses (non-printing statuses) the recording head 201 is kept the status shown in FIG. 5 to prevent eject portion of the recording head from drying.

FIG. 6 shows a status where the cap 503 is detached from the recording head 201 and the blade 507 is advanced to a position so as to contact to the recording head 201 by a pressure from a blade spring 519 so that the wiping can be executed, when the cap cam (not shown in FIG. 6) revolves further from the position in FIG. 5.

Ink is sucked as keeping the status shown in FIG. 5. Then ink remaining in the cap 503 and the pump is discharged from the recovery unit, namely the so-called dummy sucking operation can be executed by driving pump (see FIG. 3) as the cap 503 is kept being detached from the recording head 201 as shown in FIG. 6.

A plurality of color inks are mixed when the sucking operation is executed, as a result a turbid ink is formed and filled in the cap. When the cap is detached after the sucking operation, the turbid ink is mixed with ink in nozzles, as a result the so-called mixed color phenomenon such that a light color such as yellow mixed with a dark color is recorded on the sheet, might occur. Particularly immediately after detaching the cap 503 from the recording head 201, mixed turbid ink is apt to flow reversely from nozzles owing to a negative pressure in the ink tank 202 behind the recording head 201 due to a fluctuation of the pressure balance against ink.

In order to prevent the above-mentioned mixed color phenomenon, ink is ejected from the recording head 201 as the cap 503 is kept being detached from the contacting position on the liquid eject portion of the recording head 201 to the standby position after the above-mentioned sucking operation is finished. Since the turbid ink, which tends to flow into the nozzles, is pushed out of nozzles by the above-mentioned ejected ink during detaching operation of the cap 503, the mixed color phenomenon can be prevented.

As mentioned above, since the driving source power for the cap 503 is the AP motor 501 and that of the pump 506 is the LF motor, both can be driven independently on desired timings. Therefore, the pump can be driven while adjusting a detaching distance of the cap 503 from the recording head 201. More specifically, it is known fact that the stuck ink to liquid eject portion of the recording head 201 is rather easily removed when the sucking is executed by maintaining a small gap formed between the recording head 201 and the cap 503. For that purpose, the cap 503 is moved to a position detached a little bit from the recording head 201 while ink is being ejected from the recording head, in other words, the first dummy sucking is executed by driving the pump 506. Then the second dummy sucking is executed after the cap 503 is detached from the recording head completely. Thus, ink including stuck ink to the recording head 201 can be effectively removed and discharged, and at the same time ink is kept from flowing into nozzles of the recording head 201.

When the detached gap between the recording head 201 and the cap 503 during the first dummy sucking is set too large, ink removal effects around the liquid eject portion are reduced. Therefore, the detached gap should be kept preferably between 0.1 mm to 1.5 mm, which might be different depend on characteristics of ink and shapes of the recording heads.

Figure 7:
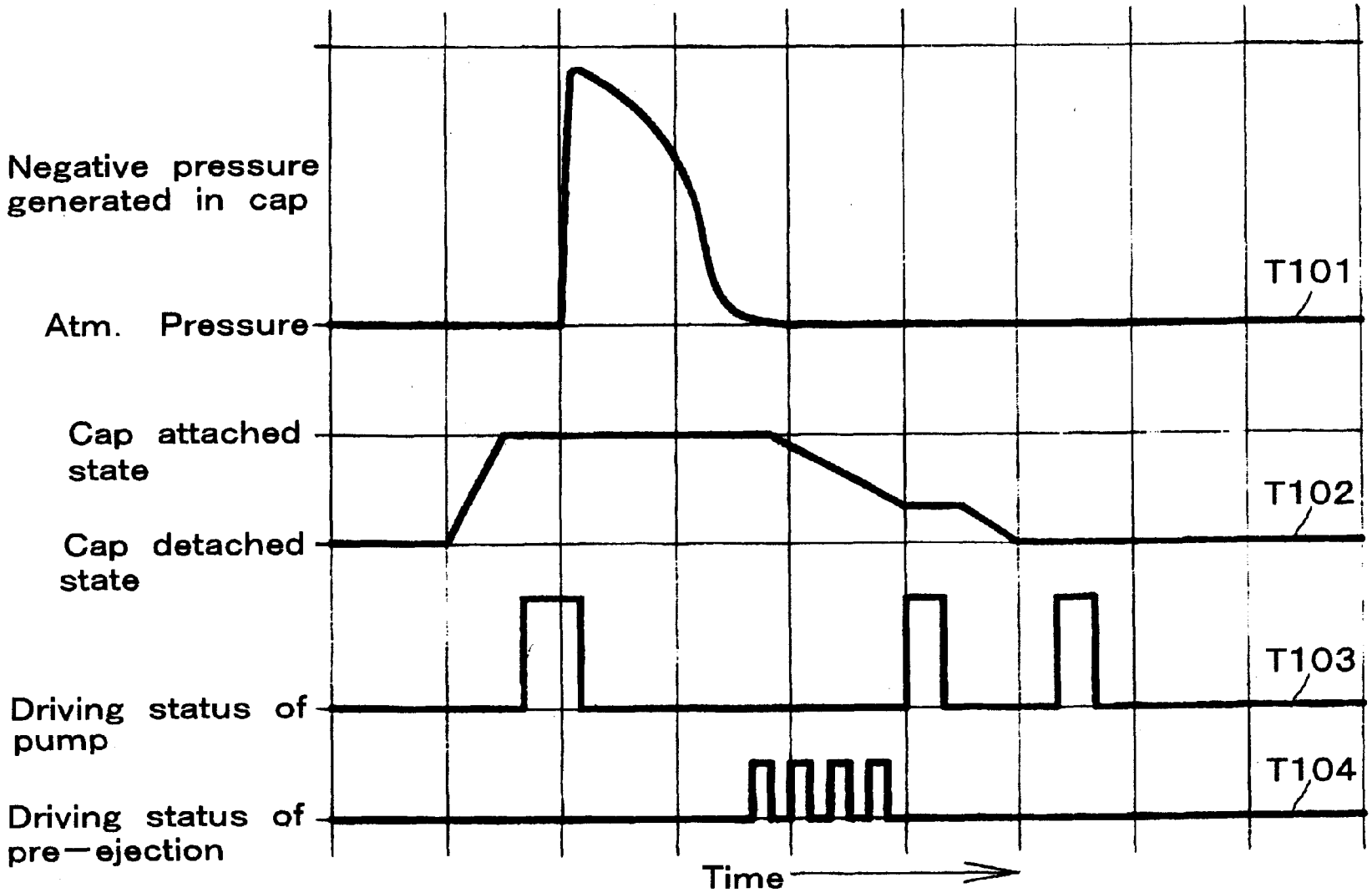
FIG. 7 is a time chart for explaining eject recovery movements of the recording head.
Figure 8:
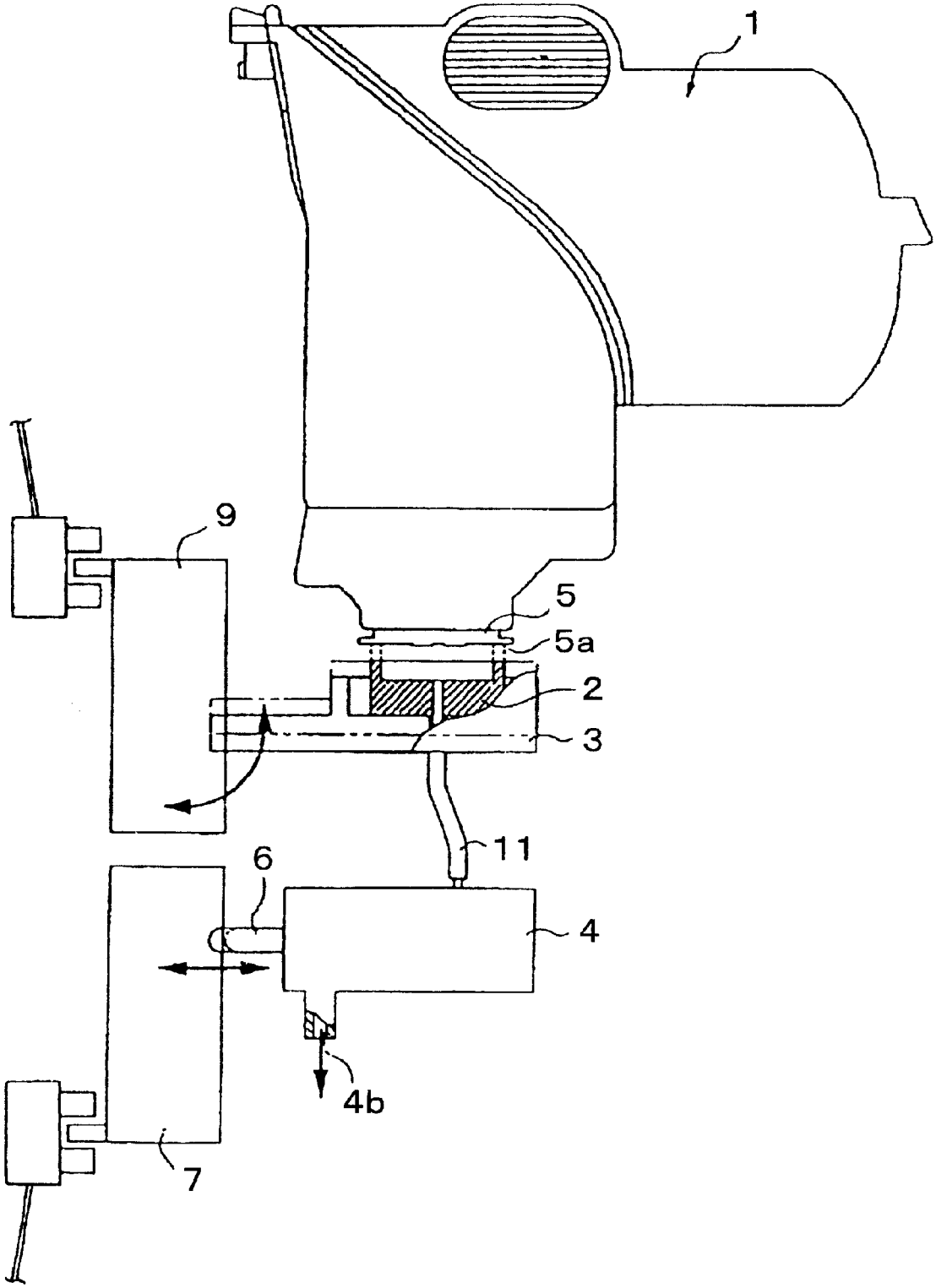
FIG. 8 (PRIOR ART)
FIG. 8 is a schematic figure showing the conventional eject recovery device.

FIG. 7 is the timing chart illustrating a series of recovering operations mentioned above.

Reference characters "T101" shows a negative pressure curve generated in the cap (in the recording head), "T102" shows a driving status of the cap, "T103" shows a driving status of the pump and "T104" shows a driving status of ink ejection (pre-ejection) from the recording head.

As shown in FIG. 7, at first the cap 503 is driven so as to attach closely to the recording head 201 and the negative pressure is caused in the cap 503 by driving the pump. Ink is sucked from the recording head 201 and the cap 503 by the above-mentioned negative pressure, but the negative pressure in the cap 503 is gradually reaching to atmospheric pressure as the sucked ink fills the cap 503 and the inside of the pump. Finally a sucked volume reaches maximum amount when the negative pressure returns to almost the atmospheric pressure.

Even the cap 503 is detached from the recording head a little bit, the turbid ink is prevented from flowing from the nozzles by ejecting ink (pre-ejection) simultaneously from the recording head 201 as the driving status T104 in FIG. 7 depicts.

Then the ink in the cap 503 and around the liquid eject portion of the recording head 210 is removed by driving the pump again as the driving status T103 in FIG. 7 depicts as the cap 503 is kept being detached a little bit. Further the discharging ink in the pump (dummy sucking) is executed by driving the pump again as the cap is kept being in a completely detached state from the recording head. Thus a series of recovering operations are finished.

The recovering operations according to the present invention are not limited in the way as described in the above-mentioned embodiment such that the dummy sucking is started after the detaching operation is finished followed by a series of the operations; namely, sucking operation, recovering the pressure in the cap 503 nearly to the atmospheric pressure and the pre-ejection from the recording head 201 as the cap is kept being detached from the recording head. For example, ink ejection from the recording head 201 can be started after the detaching movement of the cap is started.

In accordance with properties of ink or recording head, the pre-ejection from the recording head may be started before the pressure in the cap returns to the atmospheric pressure and the cap may be detached from the recording head as the pre-ejection is being continued. In this case, ink and the air is kept from flowing into nozzles when and after the cap is opened.

In accordance with properties of ink or recording head as the cap is kept being detached, the dummy ejection may be started after the pre-ejection from the recording head is started, but before the pre-ejection is finished. In this case, ink stuck to the liquid eject portion and ejected ink during the detaching operation can be removed together.

Further the pre-ejection can be executed not only during the detaching operation of the cap after the sucking operation, but also during moving the cap from the standby state to open the cap.

In the above-described embodiment, the recovery unit comprising the cap movable up/downwards for attaching to/detaching from the liquid eject portion of the recording head is explained. However, the recovery unit is not limited to the above-mentioned arrangement, the present application is applicable to any arrangements where the moving operations of the cap and pre-ejection of the recording head can be executed at any timings.

As explained above, the present invention attains recordings with high quality by ejecting liquids from the liquid eject head during detaching the cap relatively from the recording head so as to eliminate or reduce adverse effects caused due to mixing different liquids, represented by the so-called mix color phenomenon immediately after the adverse effects are caused. In addition, since the time for eject recovery is diminished according to the present invention, an overall processing rate of the liquid eject apparatus can be kept at a higher level.

What is claimed is:

1. A liquid eject apparatus comprising:

a cap for capping a liquid eject portion for ejecting liquid, wherein liquid is ejected from said liquid eject portion while said cap and said liquid eject portion are relatively moving from a closely attached state to a detached state.

2. A liquid eject apparatus comprising:

a cap for capping a liquid eject portion; and a pump for sucking liquid from said liquid eject portion via said cap, wherein after sucking by said pump is finished, liquid is ejected from said liquid eject portion while said cap and said liquid eject portion are relatively moving from a closely attached state to a detached state.

3. The liquid eject apparatus according to claim 2, wherein after sucking by said pump is finished, and after a pressure inside said cap returns to almost atmospheric pressure, the relative movement of said cap and said liquid eject portion is started.

4. The liquid eject apparatus according to claim 2, wherein after sucking by said pump is finished, and before a pressure inside said cap returns to almost atmospheric pressure, the relative movement of said cap and said liquid eject portion is started.

5. The liquid eject apparatus according to claim 2, wherein sucking by said pump is executed again as said cap and said liquid eject portion are mutually being detached.

6. The liquid eject apparatus according to claim 5, wherein a gap formed between said cap and said liquid eject portion during said detached state is set between 0.1 mm and 1.5 mm.

7. The liquid eject apparatus according to claim 5, wherein sucking by said sucking means is executed again before ejecting liquid from said liquid eject portion is finished.

8. The liquid eject apparatus according to claim 1 or claim 2, wherein ejecting liquid from said liquid eject portion during said relative movement is executed against said cap.

9. The liquid eject apparatus according to claim 1 or claim 2, wherein said cap is capping a plurality of said liquid eject portion, which respectively eject different liquids, altogether.

10. The liquid eject apparatus according to claim 1 or claim 2, wherein said liquid eject portion is equipped with electrothermal conversion modules to generate thermal energy utilized for ejecting liquid.

11. An eject recovery method comprising steps of:

relatively moving a liquid eject portion for ejecting liquid and a cap for capping said liquid eject portion from a closely attached state to a detached state; and ejecting liquid from said liquid eject portion while said eject portion and said cap are relatively moving.

12. An eject recovery method comprising steps of:

sucking liquid from a liquid eject portion while a cap caps said liquid eject portion;

relatively moving said liquid eject portion and said cap from a closely attached state to a detached state; and ejecting liquid from said liquid eject portion while said eject portion and said cap are relatively moving.

13. The eject recovery method according to claim 11, wherein after sucking liquid from said liquid eject portion, and after a pressure inside said cap returns to almost atmospheric pressure, the relative movement of said liquid eject portion and said cap is started.

14. The eject recovery method according to claim 11, wherein after sucking by said pump, and before a pressure inside said cap returns to almost atmospheric pressure, the relative movement of said liquid eject portion and said cap is started.

15. The eject recovery method according to claim 12, wherein sucking by said pump is executed again as said cap and said liquid eject portion are mutually being detached.

16. The eject recovery method according to claim 15, wherein a gap formed between said cap and said liquid eject portion during said detached state is set between 0.1 mm and 1.5 mm.

17. The eject recovery method according to claim 15, wherein sucking by said sucking means is started again before ejecting liquid from said liquid eject portion is finished.

18. The eject recovery method according to claim 11 or claim 12, wherein ejecting liquid from said liquid eject portion during said relative movement is executed against said cap.

19. The eject recovery method according to claim 11 or claim 12, wherein said cap is capping a plurality of said liquid eject portion, which respectively ejecting different liquids, altogether.

* * * * *